US006503178B1

(12) United States Patent
Gibbons

(10) Patent No.: US 6,503,178 B1
(45) Date of Patent: Jan. 7, 2003

(54) CALF MASTER

(75) Inventor: Vincent B. Gibbons, 606 Daniel Ave., Atlanta, GA (US) 30032

(73) Assignee: Vincent B. Gibbons, Decatur, GA (US)

( * ) Notice: Subject to any disclaimer, the term of this patent is extended or adjusted under 35 U.S.C. 154(b) by 0 days.

(21) Appl. No.: 09/264,482

(22) Filed: Mar. 8, 1999

(51) Int. Cl.[7] ..... A63B 21/02

(52) U.S. Cl. ..... 482/79; 482/121; 482/124; 482/907

(58) Field of Search ..... 482/79, 80, 121, 482/124; 602/23, 28

(56) References Cited

U.S. PATENT DOCUMENTS 2,439,100 A * 4/1948 Richards ..... 602/28
3,527,204 A * 9/1970 Baker ..... 602/28
3,805,773 A * 4/1974 Sichau ..... 602/28
5,215,508 A * 6/1993 Bastow ..... 482/79
5,382,224 A * 1/1995 Spangler ..... 602/23
5,542,912 A * 8/1996 Hess ..... 602/27

* cited by examiner

*Primary Examiner*—Jerome W. Donnelly

(57) ABSTRACT

An ingenious calf and ankle exerciser for engagement with the lower leg muscle and ankle which consists of a shin support w/protective pad (10), back support (14), a front support w/band brackets (16), and an adjustable sole support (30) affixed together by a pivot mechanism (24) to allow pivotal motion of the framework about substantially the same axis of the joint of the ankle, an adjustable arm (22) and an ankle connector pivot pin mechanism (37) which supports back support (14) and front support w/band brackets (16). The front support w/band brackets is swingably connected to the toe pocket w/band bracket (32) by the desired pressure resistant band (34). Then one would pull the front support w/band brackets upward to their leg and drop the back support arm w/ locking latches (15) down onto the locking catch post (18) locking the Calf Master in position. Once locked in place the, Calf Master provides swinging resistance through a range of the pivotal and lateral motion of the ankle.

2 Claims, 3 Drawing Sheets

SIDE VIEW OF FRONT & BACK SUPPORTS ON ADJUSTABLE ARM

CALF MASTER

BACKGROUND—FIELD OF INVENTION

The concept of the "Calf Master" is that of an exercise device that is specifically designed to economically isolate, tone, and workout ones calf muscles in a fashion which can be easily accomplished at home or where ever desired, without the need for weights or bulky stationary equipment.

BACKGROUND—DESCRIPTION OF PRIOR ART

Studies have shown that the calf muscle is not only one of the hardest muscles to develop in the body but also one of the most important and most neglected as well. The calf muscle plays a major part in our every day lives whether you are athletic or not but for the most part, it goes with out noticed until injured. If your calf muscles are too tight, they can't take the sudden stress, so they strain, they pop, and end up causing you real grief.

Calf muscle injuries are almost always tears of the juncture between the medial half of the calf muscle (the inner part, technically called the gastrocnemius) and the Achilles' tendon. In most cases, the muscle-tendon junction tear is caused by poor calf muscle flexibility.

Injuries such as those describe above are very serious especially those involving the Achilles tendon which more than often require surgery. These injuries can be prevented in a relatively easy fashion. You simply must keep your calf muscles stretched, flexible and strengthen at all times, Specifically with the aid of a calf machine.

Today's calf machines are bulky, weighty, stationary equipment designed for in house use in the gyms and fitness centers only. They also require a considerable amount of weight to be somewhat effective.

Originally, in order to work the calf muscles you had to place a weight bar on your shoulders with the desired weight on each side and raise up on your toes either from a flat surface or place a board, preferably a 2×4 or any thing flat and stable, about three to five inches thick under the ball of your foot to allow a broader range of motion to work the calves some what effectively. The problems with this method was that: not only do you have to focus on the exercise itself but you have to focus on balancing the weight while you raise up on your toes which takes away from the main focus: your calves.

Although this method is still widely used today, there have been several machines invented specifically for the calves. While the method of adding resistance is relatively different, the actual exercise and objective remains the same. There are two basic types of calf machines: the standing calf raise and the seated calf raise.

The standing calf raise is basically the same as using a straight bar on your shoulders with weights on either side but with out the worry of trying to balance the weight and lift at the same time. The standing calf machine regardless of the brand are very bulky heavy weight machines, often weighing a minimum of 500 pounds designed analogously and are very expensive. The standing calf machines are none portable designed specifically for the gyms and fitness centers which makes them convenient only at the facilities that are housing them.

The deficiencies surrounding these machines are all the same: the standing calf raise, though relatively effective doesn't eliminate the tendency to bounce the weight when fatigue sits in which in terms is very ineffective in working the calves. In addition to bouncing, the standing calf machines allows you the option of bending the knees, and cheating on the press, that's when you do not raise all the way up on your toes to fully contract the calf muscle or cheating on the decline, that's when you do not go down far enough to extend and or stretch the calf muscle and the Achilles' tendon which as a result is very ineffective in working the calves and can be the catalyst for future injuries. Lastly, although it is possible for you to work the calves individually, the standing calf machines are designed to work both of the calves simultaneously which makes it some what uncomfortable, and puts a bit of a strain on the lower back and spine when done individually.

The seated calf machines though extremely different in design from the standing calf machines are very effective when used properly. They allow one to ingeniously be in a seated position while working the calves. Compared to the standing calf machines, the seated calf machines are relatively small taking up half the space of the standing calf machines and weighs a lot less, around 50 to 70 pounds without weights. The cost though roughly half of that of the standing calf machines is still relatively expensive.

Though extremely more practicable than the standing calf machines, the seated calf machines are not designed to be portable thereby limiting the availability only to the facility housing the machine. Also the seated calf machines requires external weights which takes up more space and adds to its impracticability.

Although this design eliminates the added stress put on the back and shoulders caused by the standing calf machines, they too failed to eliminate the tendency to bounce the weight when fatigue. While the seated calf machines succeeded in eliminating the option of bending the knees, they failed in eliminating the option to cheat on the press, that's when you do not raise all the way up on your toes to fully contract the calf muscle or cheating on the decline, that's when you do not go down far enough to extend or stretch the calf muscle and the Achilles' tendon which as a result is very ineffective in working the calves and also like the standing calf machines can be the catalyst for future injuries.

There is no doubt that the prior arts give the calves a relative good work out but a relatively good work out is not good enough when it involves the calves. The key to developing the calf muscle is isolation; something that the prior arts failed to explore and adopt. The calves are designed to work as a team and as long as they are working together, you are more than likely to bum out trying to work out the calves than they are from your work out but by isolating the calves, you eliminate the team factor therefore forcing the calves to work independently rather the dependently and as a result, the calves are forced to work harder.

Lastly, as mentioned earlier, the Achilles' tendon more so than the calves go relatively unnoticed until an injury occur which brings me to the next disadvantage of the prior arts as a whole. The prior arts are very impracticable and inconvenient when it comes to rehabilitating an injury to the lower extremity for various reasons most of which are mentioned above.

OBJECTS AND ADVANTAGES

First and for most, the Calf Master is designed specifically to economically isolate, tone, and workout ones calf muscle effectively in a fashion which can be easily accomplished at home or where ever desired, without the need for weights or bulky stationary equipment.

Accordingly, several objects and advantages of my invention are as follows: though the Calf Master may be referred to as a home fitness device, it is designed to be very portable, able to be taken and administered virtually anywhere. The Calf Master is very light weight, weighing roughly one to two in a half pounds: a featherweight compared to the prior arts. It's extremely storage friendly, taking up the space of a medium size shoebox. The Calf Master is also very inexpensive, costing a fraction of the cost associated with the prior arts. The Calf Master is designed to be universal, one size fits all. Unlike the prior arts, the Calf Master by design gives you three options: stretch it out, work it out or both.

Once the Calf Master is locked in position, it forces you to stretch the calf muscle: something that is essential before beginning any exercise or workout. From the start or stretched position, you have no choice but to point the toes as if you were raising up on your toes on the standing calf machine or the seated calf machine but unlike those machines, no bouncing is involved. Even when fatigued, you only have three options, stretch it out, work it out or both, bouncing is not an option.

The Calf Master uses weight resistance rubber bands of different pounds per resistance to give you the required none wavering resistance.

Also unlike the standing and seated calf machines, the Calf Master is innovatively designed to isolate the calves thus making the calf muscle and the Achilles' tendon the focus of your workout. Although the Calf Master was designed to give one that added advantage in working the calves, just as important or even more so, it is also designed for rehabilitation purposes as well. The Calf Master can be used to rehabilitate the calves after a muscle strain, to rehabilitate the ankle after an ankle sprain or breakage, and most importantly the Achilles' tendon after a sprain of tear. Further objects and advantages of my invention will become apparent from a consideration of the drawings and ensuing description.

Figure 1:
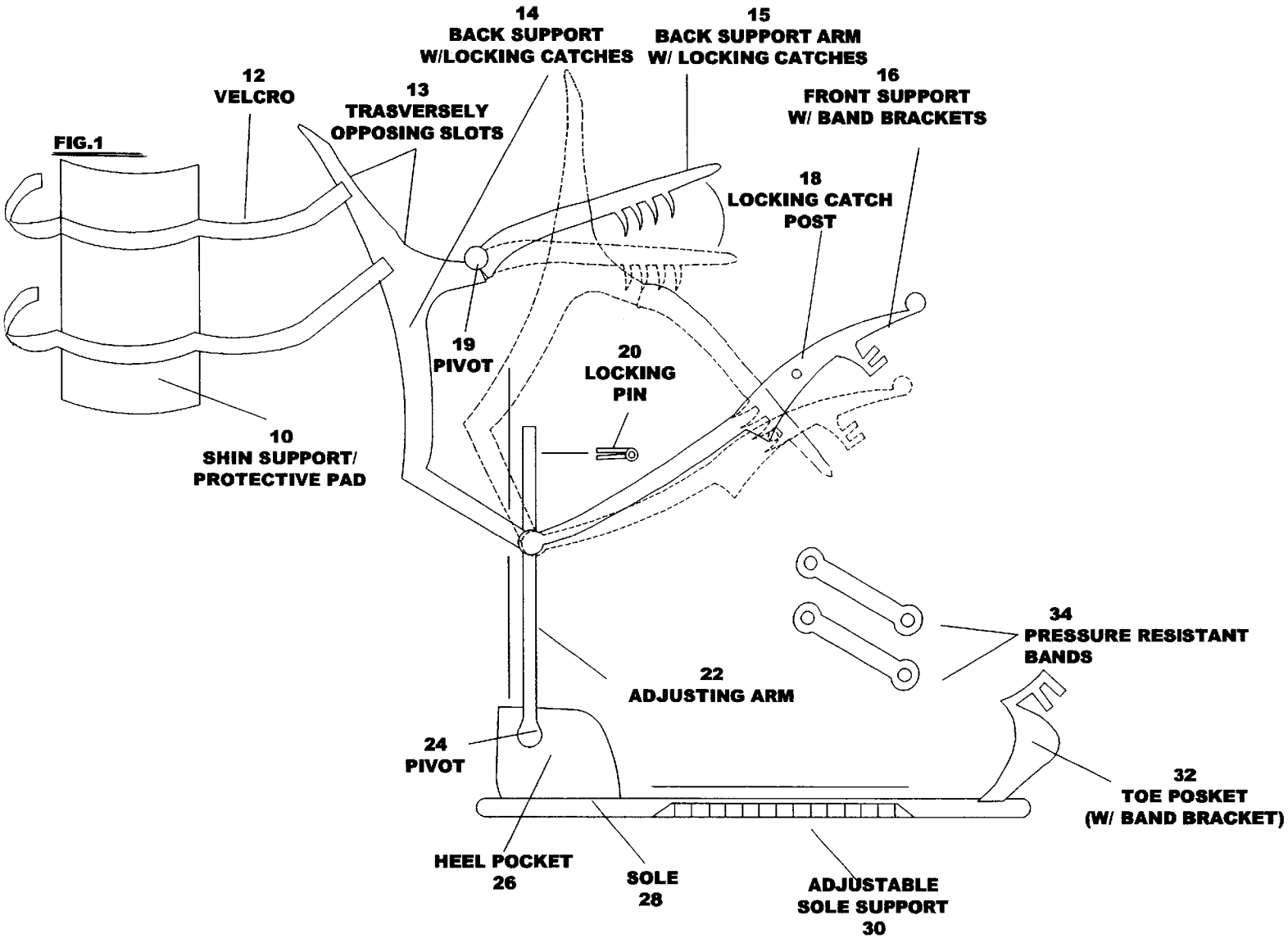
FIG. 1 is a front perspective view of a shin straps and shin protective pad of the invention.

| Reference Numerals In Drawings |
|---|
| 10 shin support/protective pad |
| 12 hook and loop strap fasteners |
| 13 transversely opposing slots |
| 14 backing support |
| 15 back support arm w/locking catches |
| 16 front support w/band brackets |
| 18 locking catch post |
| 19 pivot mechanism |
| 20 locking pin |
| 22 adjusting arm |
| 24 pivot mechanism |
| 26 heel pocket |
| 28 sole |
| 30 adjustable sole support |
| 32 toe pocket (w/band bracket) |
| 34 pressure resistant bands |
| 36 back support arm |

-continued

| Reference Numerals In Drawings |
|---|
| 37 ankle connector pivot pin |
| 38 front support arm |
| 40 adjusting arm w/pin holes |

DESCRIPTION OF INVENTION

As shown in FIG. 1, the shin support/ protective pad 10 is affixed to and is held in place by two straps with hook and loop fasteners 12 that loop through the back of the back support 14 through two pairs of transversely opposing slots 13 located on each side of a back support 14. A back support arm w/locking catches 15, located on each side of the back support 14 are affixed to back support 14 by pivot mechanism 19. A back support 14 and the front support w/band brackets 16 affixes to an ankle connector pivot pin mechanism 37 by a pair of back support arm 36 and a pair of front support arm 38, as shown in FIG. 3, for which an ankle connector pivot pin mechanism 37, which is located on both adjusting arm w/pin holes 40, allows back support 14 and front support w/band brackets 16 to be swung into position and locked in place by which a back support arm w/locking catches 15 latches onto a locking catch post 18 for which locking post 18 is permanently affixed to a front support w/band brackets 16.

Figure 3:
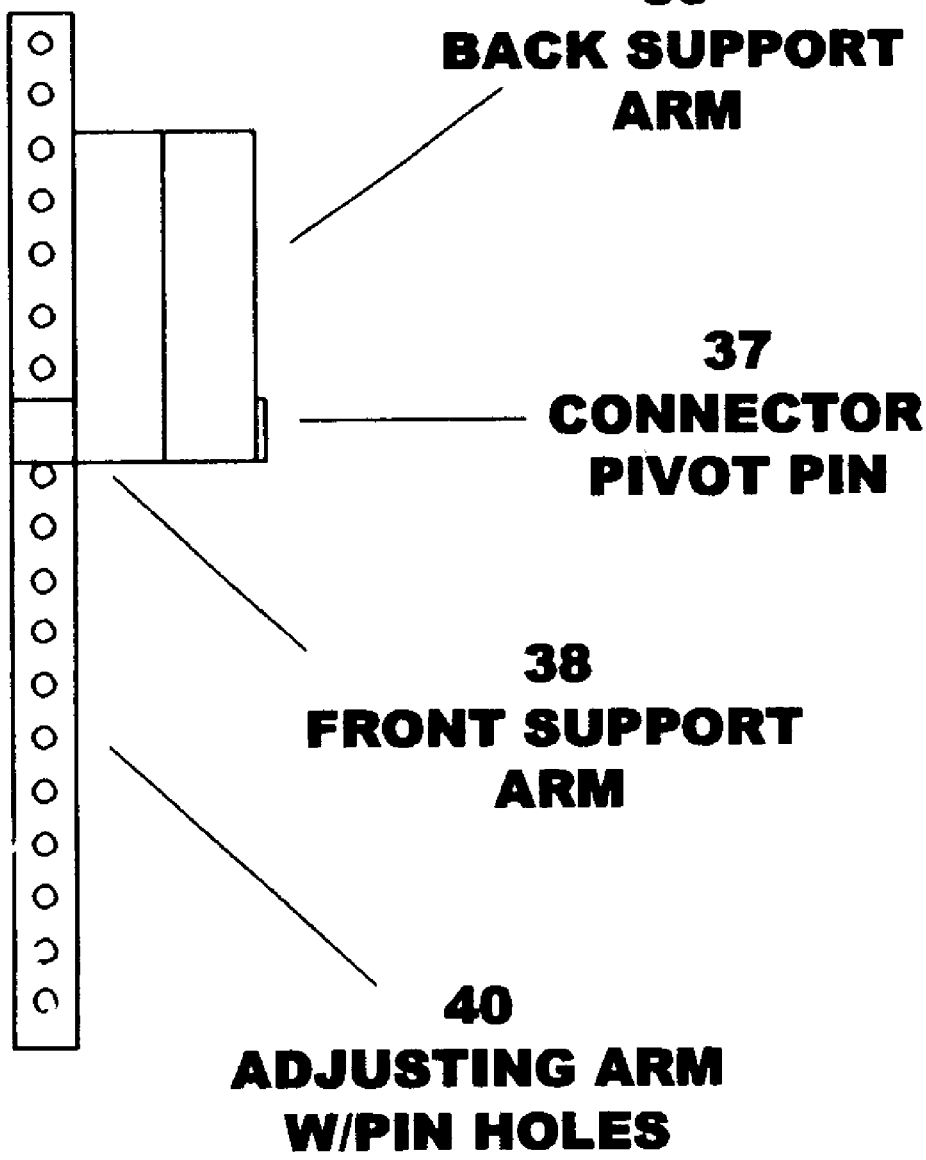
FIG. 3 is a side view of the front and back support on the adjustable arm.

As shown in FIG. 3, An adjusting arm w/pin holes 40, which is affixed to each side of a heel pocket 26 by a pivot mechanism 24, allows fronts support w/band brackets 16 and the back support 14 which is affixed to the ankle connector pivot pin mechanism 37 by back support arm 36 and front support arm 38 to be adjusted horizontally or descend for proper fit and is held in position by a locking pin 20.

Figure 2:
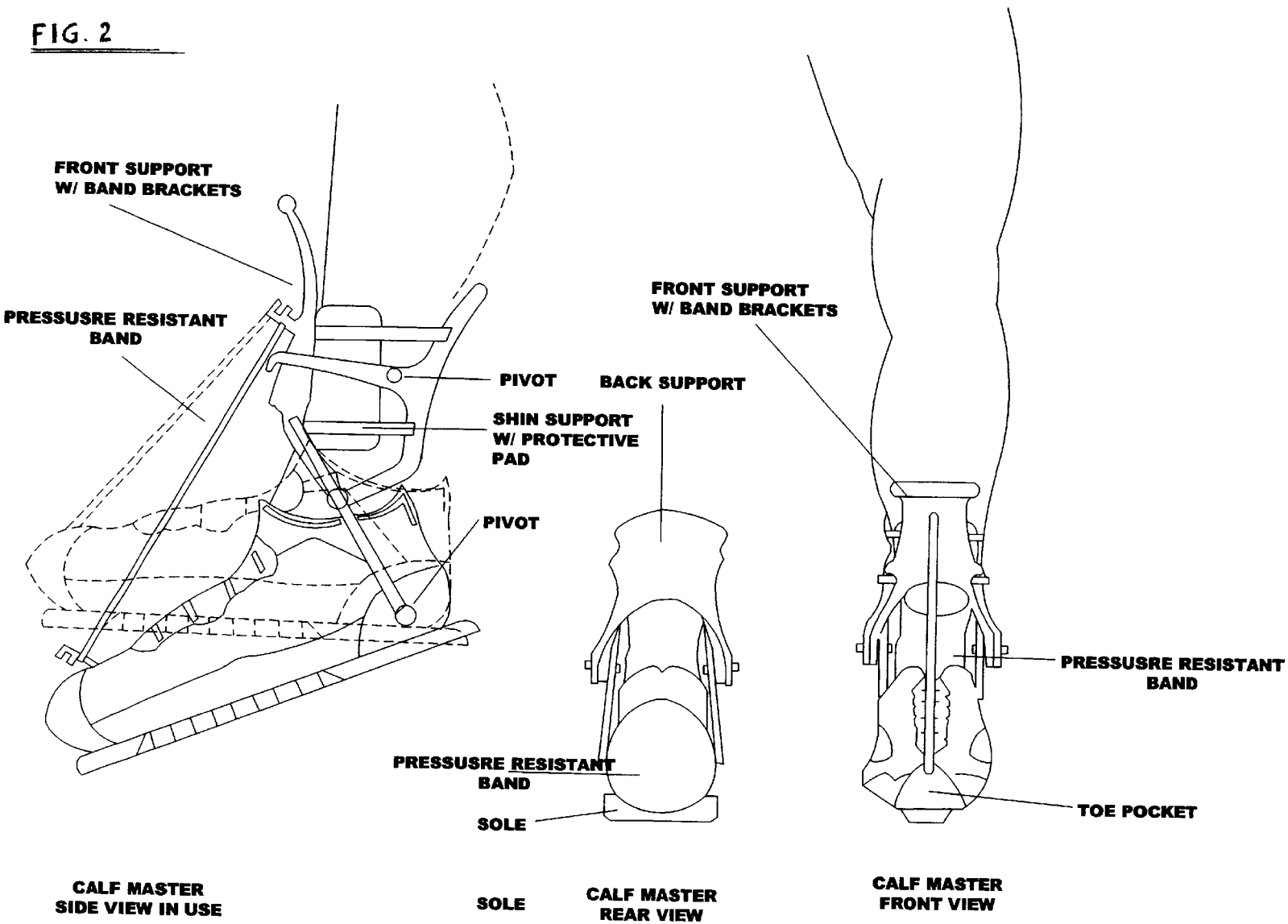
FIG. 2 is a detailed, perspective, side view of the Calf Master.

As shown in FIG. 2, a pivot mechanism 24 simultaneously with the ankle connector pivot mechanism 37 makes possible the natural articulate movement of the ankle and heel doing a calf workout and Achilles tendon stretch.

As shown in FIG. 2, a heel pocket 26 cradles the heel and holds it in position. A sole 28 is where the sole of the foot is placed in position. An adjustable sole support 30 is how the Calf Master will be adjusted to fit all. A toe pocket w/band bracket 32 is where the toe is held in position and also, this is where a pressure resistant band 34 is affixed to the toe pocket w/band bracket 32 and then to the front support w/brackets 16 where by the front support w/brackets 16 will be pulled up and locked in position by which the back support arm w/locking catches 15 will latch onto the locking catch post 18 which is permanently affixed to the front support w/brackets 16 on both sides.

Operation of Invention—FIGS. 1, 2, 3

In use, the user would simply adjust the length of the "Calf Master" as required for their shoe size, and slip their shoe into the sole support 28 with the toe and heel of the shoe inserted into the toe pocket w/band bracket 32 and heel pocket 26 (Note: the Calf Master can be worn with or with out shoes). They would then adjust the back support 14 up or down as required by means of the removable pins 20 out or the adjustment arm wiping holes 40 on each side, to cause the back support 14 to properly seat just below the user calf muscle area making sure to line up the ankle connector pivot pin 37 with the ankle. (Note: these adjustments would only need to be made when wearing the "calf Master" for the first time.) Next, they would affix the plastic rubber shin support protective pad 10 to the front of their leg and wrap the hook and loop strap fasteners 12 around the back support 14 and through the transversely opposing slots 13 securing the shin support protective pad 10 and the back support 14 in position. They would then install desired pressure resistant band 34 between the toe bracket on top or the toe pocket w/band brackets 32 and the brackets on top the front support w/band brackets 16. Then they would pull the front support w/band brackets 16 upwards to their leg and drop the back support arm w/locking catches 15 in the desired position onto the locking catch post 18. When installed, the "Calf Master" tension bands would attempt to pull the front of foot upwards towards the top of the front support 16 to give one the same stretch as if one were leaning forward against a wall to stretch the calf muscle. Then the user would point the toe as if he or she was raising up on the toes doing a calf raise by which this action would counter the pulling action of the pressure resistant bands 34 already established. The user would then exercise their calf muscles by sitting in a chair and working their feet up and down. Use of the "Calf Master" would provide an extremely effective calf work out that would isolate the calf muscle in a manner which would be much more effective than that of conventional means with the added benefit that stationary devices or weights would not be required, which would allow the user to perform the desired exercise virtually any where.

Conclusion, Ramifications, and Scope

Accordingly, the reader will see that the "Calf Master" of the invention provides a highly reliable, lightweight, yet economical device that can be used by persons of almost any age any where. In addition, the reader will also see that the "Calf Master" of the invention is more that just a device used to develop and tone all the muscles of the calf while simultaneously stretching the Achilles' tendon, but a device that is ingeniously designed for rehabilitation purposes as well. Further more, the "Calf Master" has the additional advantages in that It is extremely safe.

It can be used in bed or in a wheelchair.

It can be worn with or with out shoes.

The structure of the invention permits the patient easy entrance to and exit from the device.

It is a universal device, meaning that it can be used by anyone not only to tone the calves and keep the Achilles' tendon stretched but increase ones jumping ability without impact on the knees, increase speed, ankle strength, and lateral movement.

Asset for any sport: Basketball, Football, Baseball, Tennis, Volleyball, Soccer, Track & Field, Gymnastics, Cheerleading, Hockey, Boxer, Hockey, Swimmers, Skiers etc.

Total isolation, and progressive resistance to the Soleus, Gastroc, and Plantaris muscles.

While my above description contains many specifics, these should not be construed as limitations on the scope of the invention, but rather as an exemplification of one preferred embodiment thereof Many other variations are possible. For example, instead of having two adjusting arm supports w/pin holes 40 mounted on each side of the heel pocket 26, have one main adjusting arm w/pin holes mounted on one side of the heel pocket 26 and allow pivot mechanism 24 the luxury of being a ball and socket pivot mechanism which would enable the ankle to have more of a lateral and tilt range of motion specifically for rehabilitation purposes.

Accordingly, the scope of the invention should be determined not by the embodiments illustrated, but by the appended claims and their legal equivalents.

I claim:

1. A toning strengthening and rehabilitation device for a lower extremity comprising: a front support with a band bracket, a back support a sole support said sole support including a toe pocket with a band bracket, a heel pocket and a resilient means having attachment ends, and said front support having an upper end and a lower end, said lower end of said front support being pivotally attached to said heal pocket and said upper end of said front bracket adapted to extend to a frontal section of a users calf, said back support having an upper end and a lower end, said lower end of said back support being pivotally attached to said front support between said upper and lower end of said front support and said upper end of said back support adapted to extend to a rearward section of said users calf and;

wherein said resillient means is attached at a first end to said band bracket of said toe pocket and at a second end to said band bracket of said front support.

2. The device of claim 1 wherein the sole support is length adjustable.

* * * * *